US005586589A

United States Patent [19]

Voelker

[11] Patent Number: 5,586,589

[45] Date of Patent: Dec. 24, 1996

[54] REFILLABLE CLOSED CONTAINER SYSTEM

[75] Inventor: Scott C. Voelker, St. Louis, Mo.

[73] Assignee: Monsanto Company, St. Louis, Mo.

[21] Appl. No.: 445,362

[22] Filed: May 19, 1995

[51] Int. Cl.[6] ..... B65B 1/04; B65B 3/00

[52] U.S. Cl. ..... 141/349; 141/DIG. 1; 141/367; 215/17; 251/65; 222/147

[58] Field of Search ..... 141/DIG. 1, 349, 141/367, 383, 386, 18; 220/230; 215/17, 18, 312; 251/65, 149; 222/147, 504

[56] References Cited

U.S. PATENT DOCUMENTS

| | | | |
|---|---|---|---|
| 1,933,646 | 11/1933 | Witt et al. | 221/28 |
| 2,626,723 | 1/1953 | Onorato | 215/20 |
| 3,212,539 | 10/1965 | Felix | 251/65 |
| 3,385,327 | 5/1968 | Granier | 141/39 |
| 3,399,811 | 9/1968 | Miller | 222/147 |
| 3,484,819 | 12/1969 | Tanner | 222/147 |
| 3,640,320 | 2/1972 | Elkuch | 141/59 |
| 4,133,354 | 1/1979 | Lerner et al. | 141/18 |
| 4,195,673 | 4/1980 | Johnston et al. | 141/349 |
| 4,261,485 | 4/1981 | Borg | 222/500 |
| 4,489,863 | 12/1984 | Horchos et al. | 251/65 |
| 4,764,046 | 8/1988 | Kitamura et al. | 401/270 |
| 4,895,219 | 1/1990 | Welch et al. | 184/6.4 |
| 5,305,925 | 4/1994 | Vogel | 222/147 |
| 5,433,163 | 7/1995 | McKiernan | 141/383 |

*Primary Examiner*—Henry J. Recla
*Assistant Examiner*—Steven O. Douglas
*Attorney, Agent, or Firm*—Senniger, Powers, Leavitt & Roedel

[57] ABSTRACT

A refillable closed container that cannot be refilled without the use of a special mechanism. The refillable closed container system comprises a valve body secured in an opening of the container, a flow passage through the valve body for permitting flow into and out of the container, a magnetically attractable valve member in the valve body, and a magnet carrier. The valve member is movable between a closed position for blocking flow through the passage and an open position for permitting flow through the passage. The magnet carrier carries a magnet for magnetically moving the valve member toward an open position when the magnet carrier is secured to the container to permit refilling of the container.

31 Claims, 3 Drawing Sheets

REFILLABLE CLOSED CONTAINER SYSTEM

BACKGROUND OF THE INVENTION

This invention relates generally to containers, and more particularly to a reusable container system, and to a refilling valve for use in such a system.

Increasing waste disposal and economic concerns have for years caused industry to look for ways to economically refill and reuse containers for various products, such as liquid herbicides and other agrichemicals. However, reuse of containers is often consuming and expensive, primarily because emptied containers must be decontaminated, as by triple rinsing, before refilling.

There is a need, therefore, for a closed container system of economical construction which can readily be emptied but which cannot be refilled except by authorized refillers, so that there is no need to decontaminate the container prior to refilling.

SUMMARY OF THE INVENTION

Among the several objects of this invention may be noted the provision of an improved closed container system which can be refilled only by using a special mechanism available only to authorized refillers, thus substantially preventing any contamination of the container prior to refilling so that decontamination of the container before refilling is not necessary; the provision of such a system which can eliminate the risk of accidental cross-contamination by an authorized refiller; the provision of such a refillable closed container system which is easy to use by the consumer and by the refiller; the provision of such a refillable closed container system which is reliable in operation; the provision of such a system which can be used in connection with containers of various sizes and which can be connected to standard field equipment for removing material from the container; the provision of such a system which is environmentally safe; the provision of such a system which is economical to manufacture; and the provision of such a system which facilitates the safe refill and reuse of a container of the system.

In general, a refillable closed container of this invention comprises a closed container having an upper wall and an opening in the upper wall through which the container can be filled and emptied, a valve body in the container opening having a flow passage therethrough for permitting flow into and out of the container, a magnetically attractable valve member in the valve body, and a magnet carrier securable to the container in a position adjacent the valve body. The valve member is movable between a closed position for blocking flow through the passage and an open position for permitting flow through the passage. The valve member is gravity biased toward its closed position when the container is upright to inhibit unauthorized filling of the container through said passage and movable toward an open position to permit emptying of the container through the passage. The magnet carrier carries a magnet for magnetically moving the valve member toward an open position when the magnet carrier is secured to the container and the container is upright thereby to permit refilling of the container when the container is upright.

Other objects and features will be in part apparent and in part pointed out hereinafter.

BRIEF DESCRIPTION OF THE DRAWINGS

Corresponding parts are designated by corresponding reference characters throughout the several views of the drawings.

DESCRIPTION OF THE PREFERRED EMBODIMENT

Figure 1:
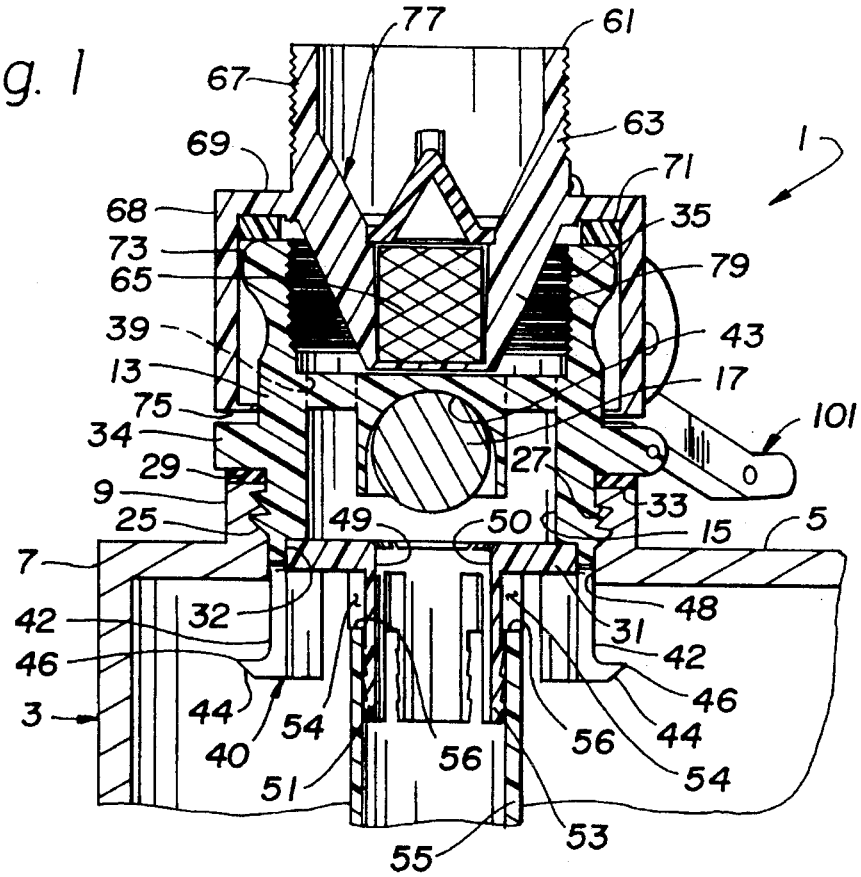
FIG. 1 is a cross-sectional view of a refillable closed container system of the present invention.

Referring now to the drawings, and first more particularly to FIG. 1, a refillable closed container system of the present invention is designated in its entirety by the reference numeral 1. As shown, the system comprises a container, generally designated 3, for holding a bulk quantity of fluent material, such as liquid fertilizer or herbicide. The container has a top wall 5, a bottom wall (not shown), and a cylindric side wall 7. An internally threaded connecting ring 9 is attached to the top wall 5 and defines an opening through which the container can be filled and emptied.

The system further comprises a valve body 13 in the container opening having a flow passage 15 therethrough permitting flow into and out of the container, and a magnetically attractable valve member 17 (shown in FIG. 1 as a spherical metal ball) in the valve body movable between a closed position for blocking flow through the flow passage and an open position for permitting flow through the passage. The valve member 17 is gravity biased toward its closed position when the container 3 is upright to inhibit unauthorized filling of the container through the flow passage 15, and it is movable toward an open position to permit emptying of the container through said passage. It will be understood that the valve member may be a solid plastic member with metal particles dispersed throughout or a member comprising plastic and metal parts, and may also be a shape other than spherical, without departing from the scope of this invention. For example, the valve member may comprise a solid or hollow plastic part recessed to receive a metal insert, and a plastic cover or cap secured in place over the recess.

More specifically, the valve body 13 has an upper part generally indicated at 19 (FIG. 4) defining an upper end of the flow passage 15 and a lower part generally indicated at 21 defining a lower end of the flow passage. The upper part 19 is generally cylindric in shape, having a central longitudinal (vertical) axis 23, and is formed with external threads 25 at its lower end which mate with the internal threads 27 of the connecting ring 9 on the container 3. As a result, the upper part of the valve body 13 projects above the top wall 5 of the container 3. An annular seal (e.g., 0-ring) 29 disposed below a radial flange 34 on the upper part 19 seals against the upper rim 33 of the connecting ring 9 to provide a fluid-tight seal between the container 3 and the valve body 13. The upper end of the upper part 19 of the valve body 13 is formed with internal threads 35 for connection of a pump or other suitable equipment to the valve body for removal of liquid from the container. It will be understood that small sizes of the container 3 can also be emptied without such equipment simply by tipping the container to pour liquid from the container.

Figure 2:
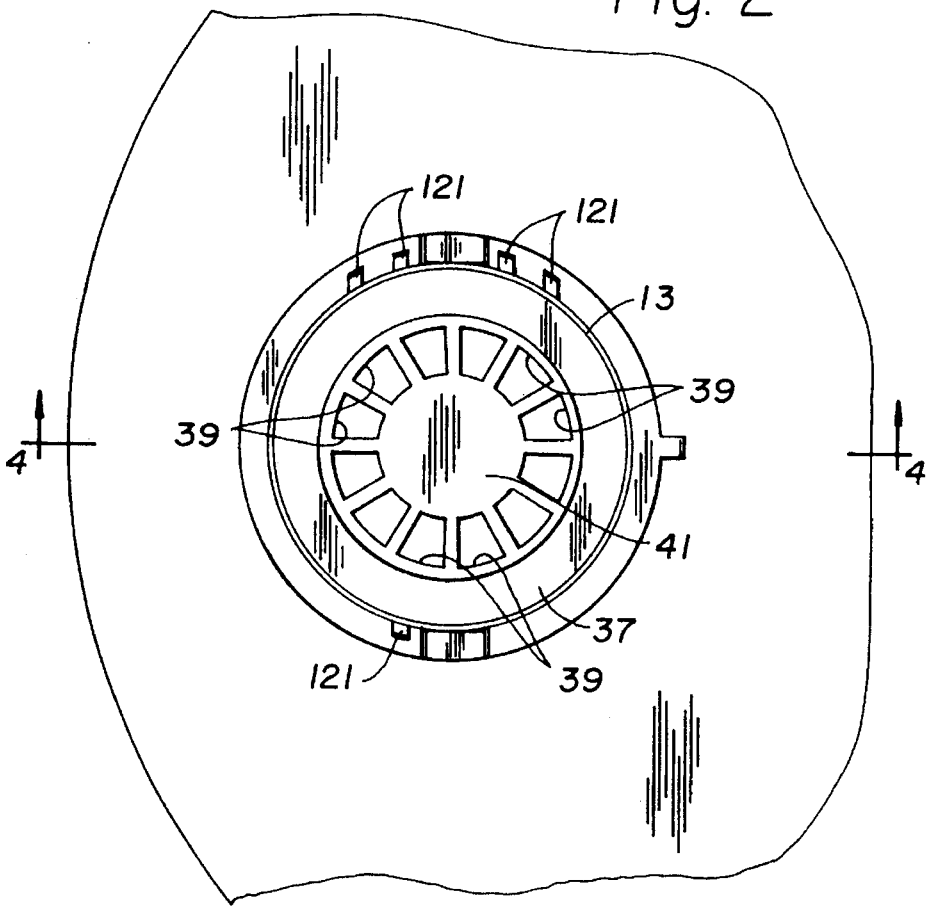
FIG. 2 is a top view of a valve body of the refilling valve system of FIG. 1 installed in a container.
Figure 3:
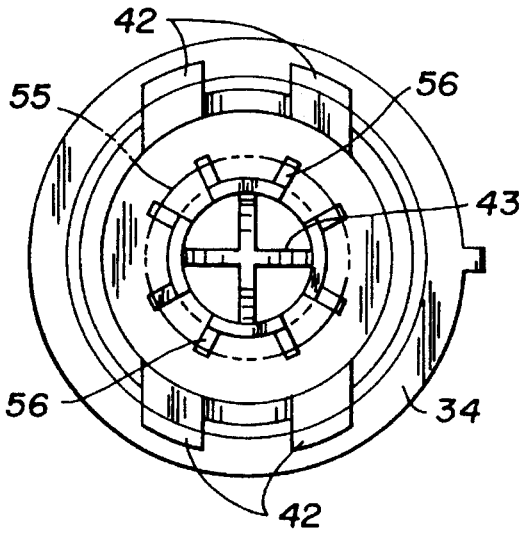
FIG. 3 is a bottom view of the valve body of FIG. 2.

As illustrated best in FIGS. 1–3, the upper part 19 of the valve body 13 is formed with an internal horizontal wall 37 which has a series of apertures 39 in it for permitting the flow of liquid therethrough. The apertures 39 are arranged in a circular formation around a solid central portion 41 of the wall 37. A downwardly facing cup-shaped valve seat 43 is formed on the underside of this central portion 41 of the wall 37. This seat 43 is sized and shaded for snug fit of the ball 17 in the seat when the ball is in a full-open position (FIG. 1), the arrangement being such that when the ball is so seated, its center is generally located on the central vertical axis 23 of the valve body 13.

Means generally indicated at 40 is provided for preventing removal of the valve body 13 once it has been installed in the opening of the container 3. This means comprises a plurality of flexibly resilient legs 42 at the lower end of the lower part 21 of the valve body 13. Each leg 42 has a foot 44 at its lower end projecting radially outwardly with respect to the flow passage 15 through the valve body 13, the outer ends 46 of the feet 44 lying on a circle having a diameter substantially greater than the opening 48 in the container. The legs 42 are designed to flex radially inwardly to permit insertion through the container opening 48 during installation of the valve body 13, and then to spring outward after they have passed through the opening to prevent removal of the valve body from the opening.

The lower part 21 of the valve body 13 comprises a thin flat annular member 31 generally coaxial with the upper part 19 of the valve body. This member 31 is secured, as by adhesive or thermal welding, within an annular recess 32 in the lower end of the upper part 19 of the valve body 13. An upwardly facing valve seat 49 is formed around the inside rim 50 of the annular member 31, the ball valve 17 being engageable with this seat when closed (FIG. 4) and being spaced above the seat when open (FIG. 1).

Figure 4:
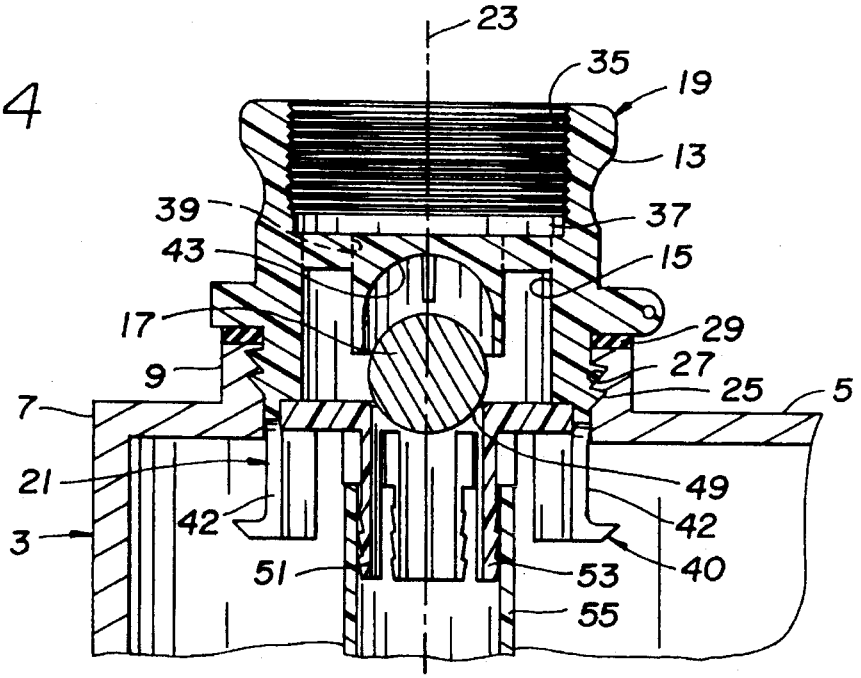
FIG. 4 is a cross-sectional view of the valve body taken on line 4—4 of FIG. 2.

The lower part 21 of the valve body 13 also includes a connector 51 for attachment of a dip tube 55 to the valve body. As shown in FIGS. 1 and 4, this connector 51 comprises a series of resiliently flexible prongs 53 extending down from the annular member 31 in a tubular formation for insertion in the upper end 54 of the tube 55 which extends down to a level adjacent the bottom wall of the container 3. The dip tube 55 is helpful in suppressing the formation of foam during filling of the container 3. The prongs 53 are spaced apart to form gaps 54 which extend from the annular member 31 down to the ends of the prongs. For smaller containers the upper end 54 of the dip tube 55 abuts up against shoulders 56 (FIG. 6) on the prongs 53 to ensure that upper portions of the gaps between the prongs 53 remain exposed (open) to permit flow of liquid out of the container 3 via the flow passage 15 in the valve body 13. It will be understood in this regard that smaller containers are typically emptied by tipping the containers to effect gravity feed out of the containers. For larger containers, where liquid is normally pumped out of the container by suitable equipment, the gaps 54 between the prongs 53 should be closed to enable the drawing of a vacuum in the container. In this situation, the dip tube allows for substantially complete emptying of the container.

The system of this invention also includes a magnet carrier 61 comprising a tubular fill cap 63 securable with respect to the container in a position adjacent the valve body 13, and a magnet 65 carried by the fill cap 63 for magnetically moving the valve member 17 toward an open position when the fill cap is secured to the container 3 and the container is upright to permit refilling of the container when the container is upright. As shown in FIG. 1, the fill cap 63 has a cylindric externally threaded upper end 67 and a cylindric lower end 68 which is somewhat larger in diameter and which is sized to fit down around the upper end of the upper part 19 of the valve body 13. The upper and lower ends 67, 68 of the fill cap 63 are connected by an annular connecting wall 69. A seal 71 disposed between this connecting wall is engageable with the top rim 73 of the valve body 13 for sealing between the fill cap 63 and the valve body. An inwardly projecting radial flange 75 at the bottom of the fill cap 63 provides a loose seal between the fill cap and the valve body 13 immediately above the flange 34 on the valve body.

Figure 6:
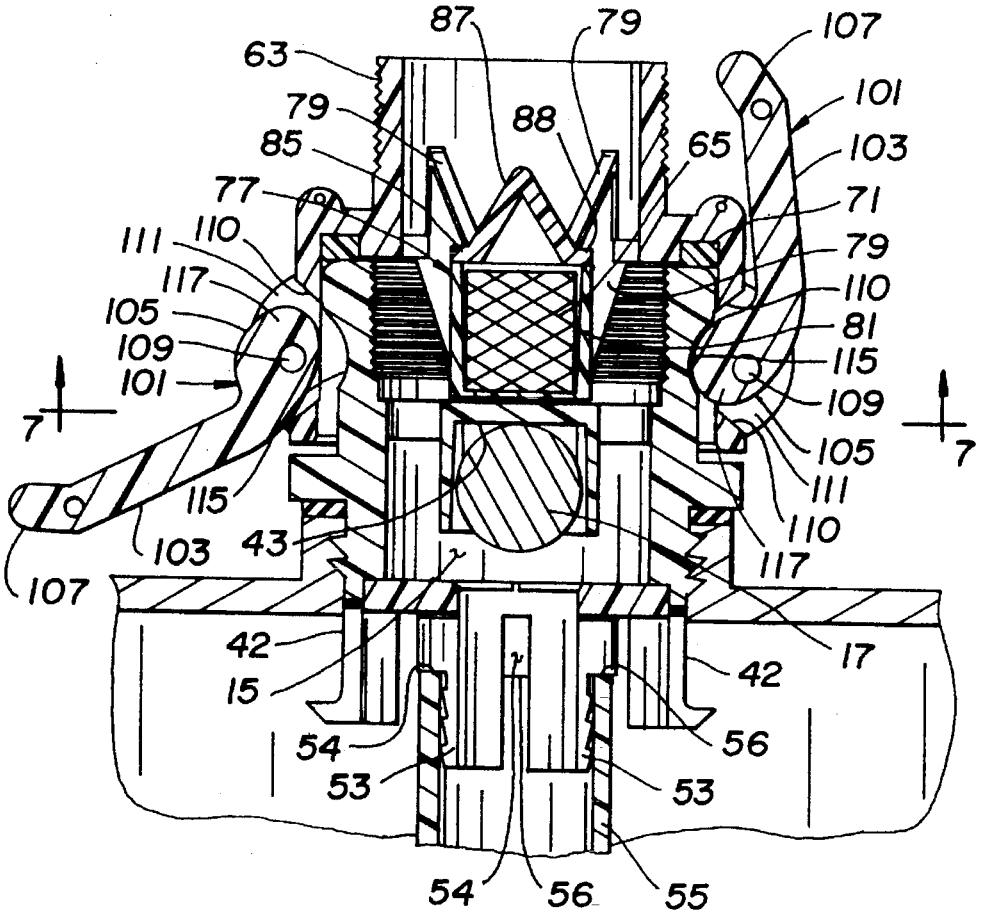
FIG. 6 is a cross-sectional view of the refillable closed container system taken on line 6—6 of FIG. 5.

A magnet holder generally indicated at 77 is provided inside the fill cap 63 for holding the magnet 65 in a position above the valve member 17 when the fill cap is secured to the valve body. The holder is formed by a series of struts 79 which are preferably integrally formed with the fill cap and which angle inwardly and downwardly from the inside wall of the upper end of the fill cap as shown in FIGS. 1 and 6, and a cup-like generally cylindric housing 81 for the magnet 65 carried by the struts 79. The configuration is such that the when the fill cap 63 is in place, the magnet is spaced immediately above the downwardly facing valve seat 43 in the valve body 13, the concept being that the magnet 65 should be sufficiently close to the valve member 17 to be able to magnetically move the valve member to an open position, such as shown in FIG. 6. The struts 79 forming the magnet holder 77 are spaced from one another and formed so that they do not substantially interfere with the flow of liquid into the container 3 during filling.

The top of the magnet housing 81 is closed by a diverter 85 which functions to protect the magnet 65 and to divert the flow of liquid radially outwardly to minimize turbulence during filling. The diverter 85 comprises an inverted cone 87 directly above the magnet. The cone is suitably secured (e.g., heat welded) in place atop the housing 81, the top rim 88 of the housing and the inner edges of struts 79 forming a seat 91 for snugly receiving the lower end of the cone (see FIG. 1).

As shown in FIGS. 1 and 6, the fill cap 63 is removably securable to the valve body by means of one or more clamps each generally indicated at 101 (two are shown). Each clamp comprises a lever 103 having inner and outer ends 105, 107, the inner end being pinned at 109 between a pair of parallel lugs 111 projecting out from the lower end portion of the fill cap for pivotal movement of the lever between raised and lowered positions. The inner end 105 of each lever 103 functions as a cam for camming the fill cap down 63 with respect to the valve body 13 when the lever is pivoted from its lowered (non-clamping) position to its raised (clamping) position. This is illustrated in FIG. 6, where it can be seen that as the levers are raised, the inner camming end 105 of each lever moves radially inwardly through an opening 110 in the cylindric wall of the fill cap and into a rounded annular groove 115 formed in the upper part of the valve body 13. The inner ends 105 of the levers 103 are so configured that as the levers are moved into a fully raised position, camming surfaces 117 on the inner ends of the levers engage surfaces of the groove 115 in the valve body 13 to force the fill cap 63 down on the upper end of the valve body 13 to bring the seal 71 tight against the upper rim 73 of the valve body. The fill cap 63 can be removed by moving the levers 103 to their lowered (non-clamping) positions.

It will be understood that other means could be used to removably secure the fill cap 63 to the valve body 13 or to the container 3 itself without departing from the scope of this invention.

Figure 7:
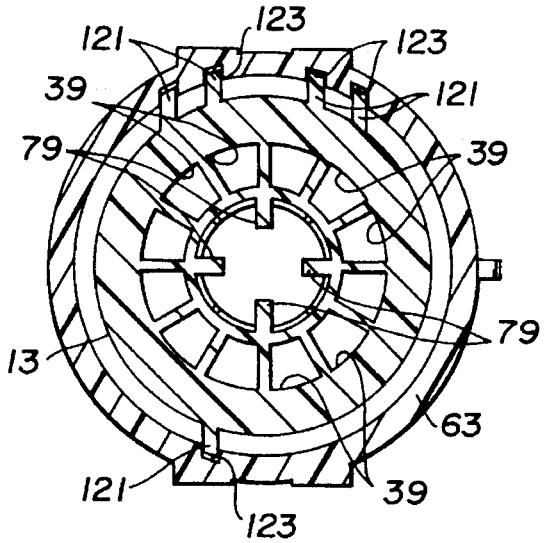
FIG. 7 is a cross-sectional view of the refillable closed container system taken on line 7—7 of FIG. 6.
Figure 5:
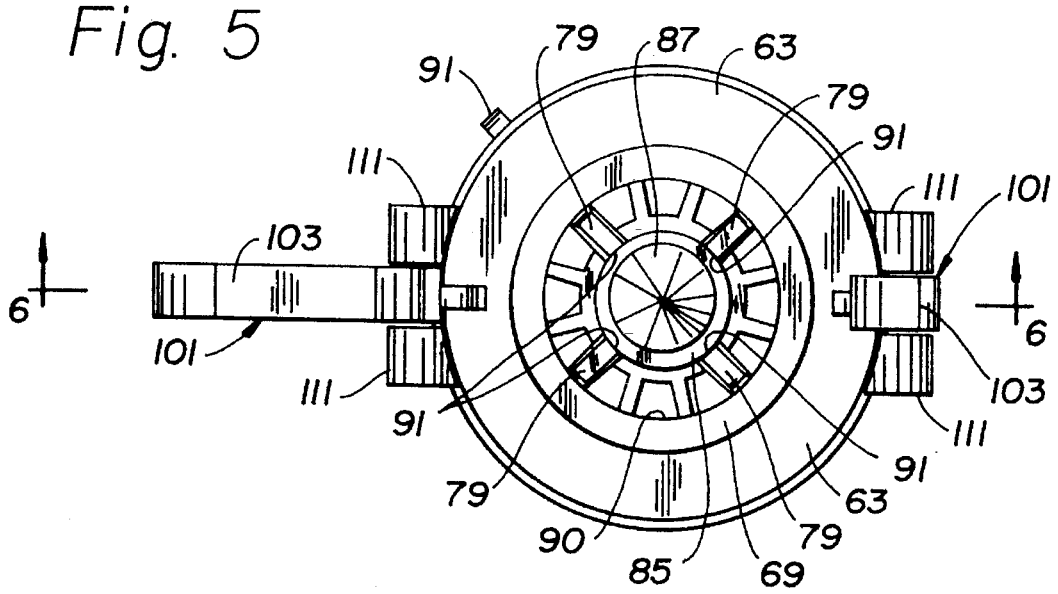
FIG. 5 is a top view of the refilling valve system of FIG. 1.

The refilling valve system may also be equipped so that a container 3 can be filled using only a particular fill cap 63. This can be accomplished by using a key and slot mechanism or means, for example. As shown in FIG. 7, the valve body 13 is formed with a specific arrangement of one or more keys 121 which fit into one or more mating slots 123 in the fill cap 63, although it will be understood that the one or more keys 121 may be on the fill cap 63 and the one or more slots 123 may be in the valve body 13. The concept is that different key 121 and slot 123 configurations correspond to different products, or different refilling locations, etc., so that a container equipped with a valve member 13 having a particular key (or slot) configuration can be filled only from a supply equipped with a fill cap having mating a key (or slot) configuration. This system can be used, for example, to prevent a container from being accidentally refilled with the wrong product at the refilling site (sometimes referred to as cross-contamination).

It will be observed from the foregoing that a closed container system 1 of this invention is easy to use. The container 3 is sold to the consumer with the valve body 13 installed. Under usual circumstances, the fill cap 63 is not provided to the consumer. As a result, the container 3 can readily be emptied (either by using a pump or simply by tipping the container to pour liquid from the container), but it cannot be refilled by the user, since the valve member 17 is gravity biased toward a closed position to prevent refilling. To refill the container 3, the consumer must take the container to an authorized source having a filling cap 63 which mates with the valve body on the container. The fill cap 63 can then be installed on the container 3 in the manner described above. Once the filling cap 63 is installed, the magnet 65 in the cap magnetically lifts the ball 17 away from its valve seat 49 to an open position, at which time the container can be refilled by connecting a filling hose or the like to the threaded upper end of the cap 63. Refilling is effecting quickly and efficiently, with the dip tube 55 minimizing foaming during refilling. After the container 3 is refilled, the fill cap 63 is removed and the container returned to the user for reuse.

A significant advantage of the system of this invention is that because the container cannot be refilled except by an authorized person having a mating refill cap, the risk of contamination of the container by the consumer is substantially eliminated. As a result, decontamination of the container prior to refilling is unnecessary, which saves time and expense. The risk of accidental cross-contamination is also eliminated, since the container can be filled using only the proper fill cap. All of this is accomplished without interfering with the normal use of the container by the user. The simplicity of the system also makes it economical.

It is contemplated that the valve body 13 and fill cap 63 will be molded plastic parts (except for the valve member 17 and magnet 65, of course), but other materials are also suitable. For ease of assembly, the upper and lower parts of the fill cap 63 are preferably formed as separate parts, and the diverter 85 may also be formed separate from the rest of the fill cap to permit placement of the magnet 65 in its housing during the manufacturing process.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

I claim:

1. A refillable closed container system comprising a closed container having an upper wall and an opening in the upper wall through which the container can be filled and emptied, a valve body in the container opening having a flow passage therethrough for permitting flow into and out of the container, a magnetically attractable valve member in the valve body movable between a closed position for blocking flow through the passage and an open position for permitting flow through the passage, said valve member being gravity biased toward its closed position when the container is upright to inhibit unauthorized filling of the container through said passage and being movable toward an open position to permit emptying of the container through said passage, a magnet carrier securable with respect to the container in a position adjacent the valve body, a magnet carried by said magnet carrier for magnetically moving the valve member toward an open position when the magnet carrier is secured with respect to the container and the container is upright thereby to permit refilling of the container when the container is upright.

2. A refillable closed container system as set forth in claim 1 wherein said magnet carrier is removably securable to the valve body.

3. A refillable closed container system as set forth in claim 2 wherein said valve body has an upper part defining an upper end of said flow passage and a lower part defining a lower end of said flow passage, said magnet carrier comprising a tubular fill cap sealingly engageable with the upper part of the valve body around the upper end of said flow passage, said fill cap having an inlet for receiving fluid and directing it to the flow passage in the valve body, and a magnet holder inside the fill cap for holding the magnet in a position above the valve member when the fill cap is secured to the valve body.

4. A refillable closed container system as set forth in claim 3 wherein said upper part of the valve body projects above the upper wall of the container, said tubular fill cap being sized to fit around said upper part of the valve body.

5. A refillable closed container system as set forth in claim 3 wherein said magnet is located generally on the central longitudinal axis of the tubular fill cap, and wherein said magnet holder comprises a magnet housing for holding the magnet, and a diverter above the housing for diverting flow away from the magnet during filling.

6. A refillable closed container system as set forth in claim 5 wherein the inlet of the fill cap, the magnet, the flow passage through the valve body, and the valve member are vertically aligned when the container is upright.

7. A refillable closed container system as set forth in claim 1 wherein said valve body and said magnet carrier are formed with mating key and slot means so that a container equipped with said valve body can be filled only from a supply equipped with a mating magnet carrier.

8. A refillable closed container system as set forth in claim 1 wherein said valve body has an upwardly facing valve seat in said flow passage through the valve body, said valve member being engageable with the valve seat when the valve member is in its closed position and being spaced above the valve seat when the valve member is in an open position.

9. A refillable closed container system as set forth in claim 8 wherein said valve body has an upper part securable to the upper wall of the container and a lower part attached to the upper part below the upper wall of the container, said upper part defining a downwardly opening cavity and said lower part being formed with said valve seat facing upwardly toward said cavity, said valve member being movable in the cavity between open and closed positions.

10. A refillable closed container system as set forth in claim 9 wherein said upper part of the valve body is formed with a downwardly facing valve seat engageable by said valve member when the valve member is in a fully open position.

11. A refillable closed container system as set forth in claim 9 further comprising a dip tube having an upper end attached to a connector on the lower part of the valve body and communicating with the lower end of the flow passage through the valve body.

12. A refillable closed container system as set forth in claim 11 wherein said connector comprises a plurality of prongs, and a plurality of gaps between the prongs, portions of said gaps being exposed when the dip tube is in place to permit flow out of the container via said flow passage in the valve body.

13. A refillable closed container system as set forth in claim 1 wherein the valve member is a metal ball.

14. A refillable closed container system as set forth in claim 1 further comprising one or more clamps for removably clamping the magnet carrier to the valve body.

15. A refillable closed container system as set forth in claim 1 further comprising means for preventing removal of the valve body from the container after it has been installed in said opening of the container.

16. A refilling valve system for a closed container having an upper wall and an opening in the upper wall through which the container can be filled and emptied, said valve system comprising a valve body adapted for securement in the container opening, said valve body having a flow passage therethrough, a magnetically attractable valve member in the valve body movable between a closed position for blocking flow through the flow passage and an open position for permitting flow through the flow passage, said valve member being gravity biased toward its closed position when the container is upright to inhibit unauthorized filling of the container through said flow passage and being movable toward an open position to permit emptying of the container through said flow passage, a magnet carrier removably securable with respect to the container in a position adjacent the valve body, a magnet carried by the magnet carrier for magnetically moving the valve member toward an open position when the magnet carrier is secured with respect to the container and the container is upright thereby to permit refilling of the container when the container is upright.

17. A refilling valve system as set forth in claim 16 wherein said magnet carrier is removably securable to the valve body.

18. A refilling valve system as set forth in claim 17 wherein said valve body has an upper part defining an upper end of said flow passage and a lower part defining a lower end of said flow passage, said magnet carrier comprising a tubular fill cap sealingly engageable with the upper part of the valve body around the upper end of said flow passage, said fill cap having an inlet for receiving fluid and directing it to the flow passage in the valve body, and a magnet holder inside the fill cap for holding the magnet in a position above the valve member when the fill cap is secured to the valve body.

19. A refilling valve system as set forth in claim 18 wherein said tubular fill cap is sized to fit around said upper part of the valve body.

20. A refilling valve system as set forth in claim 18 wherein said magnet is located generally on the central longitudinal axis of the tubular fill cap, said magnet holder comprising a magnet housing for holding the magnet, and a diverter above the magnet housing for diverting flow away from the magnet during filling.

21. A refilling valve system as set forth in claim 20 wherein the inlet of the fill cap, the magnet, the flow passage through the valve body, and the valve member are aligned along a common axis.

22. A refilling valve system as set forth in claim 20 wherein said valve body and said magnet carrier are formed with mating key and slot means so that a container equipped with said valve body can be filled only from a supply equipped with a mating magnet carrier.

23. A refilling valve system as set forth in claim 16 wherein said valve body has an upwardly facing valve seat in said flow passage through the valve body, said valve member being engageable with the valve seat when the valve member is in its closed position and being spaced above the valve seat when the valve member is in an open position.

24. A refilling valve system as set forth in claim 23 wherein said valve body has an upper part securable to the upper wall of the container and a lower part attached to the upper part below the upper wall of the container, said upper part defining a downwardly opening cavity and said lower part being formed with said valve seat facing upwardly toward said cavity, said valve member being movable in the cavity between open and closed positions.

25. A refilling valve system as set forth in claim 24 wherein said upper part of the valve body is formed with a downwardly facing valve seat engageable by said valve member when the valve member is in a fully open position.

26. A refilling valve system as set forth in claim 24 further comprising a dip tube having an upper end attached to the lower part of the valve body and communicating with the lower end of the flow passage through the valve body, said dip tube being adapted to extend down into the container.

27. A refilling valve system as set forth in claim 26 wherein said connector comprises a plurality of prongs, and a plurality of gaps between the prongs, portions of said gaps being exposed when the dip tube is in place to permit flow out of the container via said flow passage in the valve body.

28. A refilling valve system as set forth in claim 16 wherein the valve member is a metal ball.

29. A refilling valve system as set forth in claim 16 further comprising one or more clamps for removably clamping the magnet carrier to the valve body.

30. A refilling valve system as set forth in claim 29 wherein said clamps comprise a plurality of levers on the magnet carrier, each lever being mounted for movement between a non-clamping position to permit application and removal of the magnet carrier to and from the valve body, and a clamping position in which the lever is clampingly engageable with the valve body for clamping the magnet carrier on the valve body.

31. A refilling valve system as set forth in claim 16 further comprising means for preventing removal of the valve body from the container after it has been installed in said opening of the container.

* * * * *